US012209471B2

(12) United States Patent
Haugland et al.

(10) Patent No.: US 12,209,471 B2
(45) Date of Patent: Jan. 28, 2025

(54) DEVICE FOR EMPTYING A WIRELINE OPERATED WELLBORE DEBRIS CLEAN OUT TOOL AND A METHOD FOR USING THE DEVICE

(71) Applicant: Altus Intervention (Technologies) AS, Stavanger (NO)

(72) Inventors: Lasse Haugland, Bryne (NO); Espen Osaland, Sandnes (NO); Bard Martin Tinnen, Stavanger (NO)

(73) Assignee: Altus Intervention (Technologies) AS, Stavanger (NO)

( * ) Notice: Subject to any disclaimer, the term of this patent is extended or adjusted under 35 U.S.C. 154(b) by 0 days.

(21) Appl. No.: 17/289,572

(22) PCT Filed: Nov. 12, 2019

(86) PCT No.: PCT/NO2019/050249

§ 371 (c)(1),
(2) Date: Apr. 28, 2021

(87) PCT Pub. No.: WO2020/101505

PCT Pub. Date: May 22, 2020

(65) Prior Publication Data

US 2022/0010641 A1 Jan. 13, 2022

(30) Foreign Application Priority Data

Nov. 13, 2018 (NO) ..... 20181450

(51) Int. Cl.
*E21B 27/00* (2006.01)
*E21B 33/072* (2006.01)
*E21B 37/00* (2006.01)

(52) U.S. Cl.
CPC ..... *E21B 27/00* (2013.01); *E21B 33/072* (2013.01); *E21B 37/00* (2013.01)

(58) Field of Classification Search
CPC ..... E21B 27/00; E21B 37/00; E21B 33/072; E21B 33/068
See application file for complete search history.

(56) References Cited

U.S. PATENT DOCUMENTS 3,500,907 A * 3/1970 Gentry ..... E21B 33/076 166/70
3,637,009 A 1/1972 James
(Continued)

FOREIGN PATENT DOCUMENTS

WO 03036020 5/2003
WO 2015142184 9/2015
(Continued)

OTHER PUBLICATIONS

Tool String. (n). In Schlumberger Energy Glossary. Retrieved Apr. 27, 2023, from https://glossary.slb.com/en/terms/t/tool_string (Year: 2023).*

*Primary Examiner* — Robert E Fuller
(74) *Attorney, Agent, or Firm* — GableGotwals

(57) ABSTRACT

A circulation unit for connecting to a lubricator suitable for housing a wireline operated tool string for collecting debris within a petroleum well. The circulation unit comprises a house with an upper lubricator connection and at least one lower internal seal member adapted to seal against an outer surface of the tool string. The circulation unit has an outlet above the seal member, the outlet being connected to a reservoir. The circulation unit has a lower lubricator connection. The house, upper lubricator connection and lower lubricator connection form a through passage for the tool string. The upper lubrication connection and lower lubrication connection are adapted for connection to a pressurized lubricator. The tool string includes a wellbore cleanout tool with filling means. The wellbore cleanout tool comprises an
(Continued)

outlet for unloading collected debris in a lubricator assembly comprising the lubricator and the circulation unit.

19 Claims, 11 Drawing Sheets

(56) References Cited

U.S. PATENT DOCUMENTS

| | | | |
|---|---|---|---|
| 5,048,603 | A | 9/1991 | Bell et al. |
| 5,893,417 | A | 4/1999 | Pizzolato |

FOREIGN PATENT DOCUMENTS

| | | |
|---|---|---|
| WO | 2016148576 | 9/2016 |
| WO | 2017142504 | 8/2017 |
| WO | 2017146587 | 8/2017 |
| WO | 2018117854 | 6/2018 |

* cited by examiner

DEVICE FOR EMPTYING A WIRELINE OPERATED WELLBORE DEBRIS CLEAN OUT TOOL AND A METHOD FOR USING THE DEVICE

CROSS-REFERENCE TO RELATED APPLICATIONS

This United States application is the National Phase of PCT Application No. PCT/NO2019/050249 filed 12 Nov. 2019, which claims priority to Norwegian Patent Application No. 20181450 filed 13 Nov. 2018, each of which is incorporated herein by reference.

FIELD OF THE INVENTION

The invention relates to a device for efficient unloading of collected debris from a well in the ground, in which the debris is collected and transported out of the well with a wireline or coiled tubing operated tool string, comprising a wellbore cleanout tool that gathers debris downhole, for then to be hoisted out of the well and unloaded. Said wellbore cleanout tool could be an auger based, suction based, or jetting based tool conveyed on wireline, or it could be a venturi basket conveyed and operated on coiled tubing, or some other tool design based on other working principle or combination thereof, as would be appreciated by a person skilled in the art. More particularly, the well is associated with the production of hydrocarbons, by means of producing hydrocarbons from it or injecting driving fluids such as gas or water into it, and the unloading of the wellbore cleanout tool is carried out when the tool string is positioned in a lubricator at the top of the well. Even more particularly, the device for unloading the wellbore cleanout tool is connected to the lubricator such that the lubricator extends above and below the device. The device comprises sealing means and an outlet such that the debris is transported out of the wellbore cleanout tool, through the device and the outlet and to a suitable external receptacle. In one embodiment of the invention, the process of emptying the wellbore cleanout tool is carried out in such a manner that the pressure within the lubricator is maintained at a level substantially corresponding with the well pressure.

BACKGROUND OF THE INVENTION

It is well known in the petroleum industry that debris and deposits, collectively termed debris, may accumulate in the production tubular of a well. The debris may be in the form of sand or other particles produced into the wellbore from the reservoir, or salt or other agents that deposit on the production tubing in the form of layers or bridges of scale, wax and asphaltenes, or it may be in the form of particles that have settled out from drilling mud, or from other origin as would be appreciated by a person skilled in the art. Said debris may form a narrow passage choking the production flow or may block the production flow and/or wellbore completely. It is also known that mud remnants accumulating on top of completion barriers which are used when completing a well, prevent correct operation of said barriers, and must be removed to access and open the completion barrier, hence bringing the completion operation forward. Also, debris often forms an obstacle for the passing of intervention tools and make well intervention work difficult.

The particles may be fine particles such as fine sand and silt. Sand may be produced from one or several production zones, and some production zones may be blocked completely. Production tubing in deviating and in horizontal wells, and also S-formed well paths comprising horizontal and vertical portions, may be particularly exposed for settling of debris and congestion. Production from a petroleum well is most efficient when the well path is clean and free from sand and debris.

It is known to use coiled tubing washing/circulation techniques for cleaning constricted or blocked wells, where the debris is circulated out of the well, sometimes in one continuous motion, instead of the debris sequentially being collected into a wellbore cleanout tool, hoisted and unloaded as per the invention herein. Such coiled tubing operation may wash out a considerable amount of debris in a short time, which is advantageous, because in a short time a portion of considerable length can be washed out and blocked production zones reopened. However, coiled tubing conveyed operation suffers from several disadvantages measured up against wireline conveyed operations, in particular on offshore installations. A coiled tubing operation involves transporting and rigging numerous heavy equipment units, including the coil reel, and a tower comprising a gooseneck for introduction of the coiled tubing into the well. Thus, a considerable number of units are transported by ship to an offshore installation or on trucks to land based units, and a number of heavy lifts being required to install the equipment in place. For offshore operations, the lifting of heavy equipment modules, hence the entire clean out operation, may be paused due to bad weather. In addition, installation of the coiled tubing equipment may require relocation of other equipment or entail other associated consequences to the logistics and operative priorities on said offshore installation. Finally, a relatively high number of personnel is required for the conduct of coiled tubing operations.

After completed mission, the coiled tubing is demobilized with the same logistic implications. The total cost of a coiled tubing operation is high, therefore a clean out operation may be put off as long as possible and may even be avoided.

In many cases, where debris must be transported out of a well in stages, the use of coiled tubing is replaced by wireline and, in some cases, combined wireline-tractor-powered mechanical cleanout technology. In one embodiment, powered mechanical cleanout technology utilizes mechanical means for directly, such as using a transport auger, or indirectly, such as operating a pump, to create suction transporting debris into a collecting chamber. In alternative embodiments, the collecting chamber may collect debris by applying a sub-pressure in the collecting chamber relative to the ambient pressure (hydrostatic bailer principle) and opening a valve arrangement when the tool has been landed on top of the debris, to create a suction effect. A general feature for all wireline conveyed wellbore cleanout tool technologies is that when the collecting chamber is full, the tool is hoisted to the surface of the well, whereupon the collecting chamber is emptied. Pending on the scope of the operation and the total volume of debris in the well, the tool may be prepared for a new run, and the exercise repeated until a relevant volume of debris has been removed from the well. There are limitations to this method with respect to what volumes that can be retrieved from the well in one run, and the method is time consuming because of the total time taken to sequentially/repeatedly rig tools into the lubricator, perform the cleanout operation in the well, hoist the tool out, empty it, prepare it for a new run and rig it into the lubricator again.

As a precautionary measure, to avoid the production and accumulation of produced debris, wells may be drained gently to avoid that sand and silt are brought into the production tubing.

Cleaning wells for debris by means of wireline-operated tools is overall efficient if the volume of debris is limited. Here, a roundtrip in the well collects a rather small volume of debris per run. However, the mobilization of wireline is easy compared to the mobilization of a coiled tubing operation, and the total work and logistic effort involved is very moderate in comparison. On the other hand, a wireline-operated tool is inefficient in removal of substantial amounts of debris compared to a coiled tubing wash out operation.

As per the above, method selection for debris cleanout operations often becomes a trade-off between volume of debris present in the well and the total cost of a cleanout operation conducted on wireline or coiled tubing, respectively. In some situations, the total cost favours a coiled tubing operation, and, in some situations, a wireline conveyed cleanout operation being the preferred choice. An ordinary coiled tubing operation on an offshore installation may last for between two and four weeks from start of mobilization and to complete demobilization. An ordinary wireline operation may last for a comparable shorter period, typically from 5 to 10 days. A round trip with a wireline using current technology and tools may last for 6-12 hours. Known wellbore cleanout equipment has a capacity of collecting between 10 and 50 litres of debris in each round trip in the well.

Washing out the debris by circulating fluids from the surface of the well is only possible using coiled tubing and cannot be performed with wireline operated tools (as there is no top to bottom circulation means associated with this service).

To illustrate further, the below example is given, relating to a wireline operation for cleaning out debris in a well having a production tubing with an internal diameter of 177.8 mm (7 inch):

The volumetric capacity being 19.38 litres per meter.

A 100 m long column of debris in this tubing comprises 1938 litres of debris.

Maximum capacity of a wireline operated wellbore cleanout tool is 50 litres.

A minimum of 39 round trips being required for complete collection of the debris.

Each round trip requiring between 6 and 12 hours.

A total of 10 to 20 days being required for this operation.

Further to the above example; for this scenario, coiled tubing would normally be the preferred choice to clean out the well. Despite an easier mobilisation exercise and lower daily cost, the time consumption for a wireline orchestrated cleanout operation as per the above example would typically be too long to justify.

A collected volume of 50 litres is generally recognized as a large volume for a round trip using a wireline-based wellbore cleanout tool. In many cases, the collecting capacity per run may be smaller due to restrictions in the well path, limiting the outer diameter of the cleanout tool, and also due to height limitations on the tool sluice system, which is termed as the lubricator. The length of the lubricator is related to rigging constraints, such as crane height, and the maximal permitted length of tool string being defined by the lubricator height again.

U.S. Pat. No. 5,893,417 discloses an apparatus for preventing leakage and spillage of oil from a wellhead or a wireline lubricator when the lubricator is disconnected from a Christmas Tree, i.e. after bleeding off the pressure within the lubricator. The apparatus is connected to the bottom of the lubricator.

SUMMARY OF THE INVENTION

In view of the above, there is a clear need for improving existing systems and methods for cleaning a production tubing in a petroleum well. Key to making wireline-based cleanout operations more efficient is to reduce the turnaround time associated with a run in the well. One enabler being emerging wireline cable technologies that allow for a higher running and hoisting speed than what is possible with prior art technology. Another enabler, according to the present innovation, being a system and method that significantly reduces the time associated with unloading a wireline-based wellbore cleanout tool on the surface and preparing it for a subsequent run. Traditionally, as per prior art, a wireline-based wellbore cleanout tool has to be lifted out of the lubricator, unloaded, prepared for a new run and then hoisted into the lubricator again in conjunction with each run in the well. This, together with the time it takes to bleed off pressure from the lubricator before lifting the tool out, and re-pressurising the lubricator prior to running the tool in the hole again, being a major contributor to a long turnaround time, hence overall time it takes to remove larger amounts of debris from a well using wireline. The main goal of the present invention is to enable surface unloading and between-run maintenance of a wellbore cleanout tool without removing it from the lubricator between runs.

The invention has as its object to remedy or to reduce at least one of the drawbacks of the prior art, or at least provide a useful alternative to prior art.

The object is achieved through features, which are specified in the description below and in the claims that follow.

The invention is defined by the independent patent claims. The dependent claims define advantageous embodiments of the invention.

In a first aspect the invention relates more particularly to a circulation unit for connecting to a lubricator. The lubricator is suitable for housing a wireline operated tool string for collecting debris within a petroleum well. The circulation unit comprises a house provided with an upper lubricator connection and at least one lower internal seal member. The seal member is adapted to seal against an outer surface of the tool string. The circulation unit is provided with an outlet above the seal member and the outlet is connected to a reservoir. The circulation unit is provided with a lower lubricator connection. The house, the upper lubricator connection and the lower lubricator connection form a through passage for the tool string. The upper lubrication connection and the lower lubrication connection are adapted for connection to a pressurized lubricator.

A primary fluid surrounds the tool string when the tool string is hoisted into the lubricator. The primary fluid may be a well fluid. The circulation unit is a device that guide a secondary fluid which has been introduced into the lubricator, out of the lubricator through an outlet in the circulation unit.

The upper lubricator connection may comprise a box portion with external threads. The lower lubricator connection may comprise a pin portion, a flange and a collet provided with internal threads. Such box portion and pin portion are known in the art of assembling a lubricator from lubricator sections by threaded connections.

The lower seal member may seal against the surface of the tool string when the lower seal member is in an active position. The lower seal member may be retracted from the surface of the tool string when the lower seal member is in a passive position. In an alternative embodiment the lower seal member may be a wiper seal.

The circulation unit may comprise an upper seal member and the upper seal member may be positioned above the outlet. The upper seal member may seal against the surface of the tool string when the upper seal member is in an active position. The upper seal member may be retracted from the surface of the tool string when the upper seal member is in a passive position. In an alternative embodiment the upper seal member may be a wiper seal.

The circulation unit may comprise an inlet and the inlet may be positioned above the lower seal member. The inlet may be positioned below the upper seal member.

The circulation unit may comprise opening means for displacing a displaceable sliding port on the tool string. The sliding port may be displaced axially along the longitudinal direction of the tool string. The sliding port may be displaced rotationally along the periphery of tool string. The opening means may be an internal constriction. The opening means may be a locking profile. The circulation unit may be provided with orientation means that engage with corresponding orientation means in the outlet of the wellbore clean out tool such that the holes in the gate portion are oriented and aligned with respect to the holes in the outlet of the circulation unit.

The invention also concerns a lubricator assembly comprising a lubricator and a circulation unit as described above. The lubricator assembly may be provided with a filter cleaning unit for cleaning a filter in the tool string. The filter may be positioned on the surface of a wellbore cleanout tool. The filter may be positioned on a sliding port connected to the wellbore cleanout tool. The filter cleaning unit may be positioned below the circulation unit.

In a second aspect the invention relates more particularly to a tool string for collecting debris within a petroleum well, said tool string comprises a wellbore cleanout tool which forms a leading end portion and an opposite outlet end portion, and is provided with filling means at an inlet at the leading end portion. The outlet end portion comprises an outlet mandrel at an outlet for unloading collected debris. The outlet mandrel comprises a gate portion with through holes, and the tool string further comprises a sliding port provided with a filter adapted to cover the gate portion and slidable to uncover the gate portion. The sliding port is adapted to be displaced within a lubricator provided with a circulation unit. The lubricator and the circulation unit may form parts of a lubricator assembly.

In a third aspect the invention relates more particularly to a method for unloading a filled wellbore cleanout tool positioned in a tool string. The wellbore cleanout tool forms a leading end portion and an opposite outlet end portion, where the method comprises:

- the tool string is positioned within a lubricator assembly comprising a lubricator and a circulation unit;
- a lower seal member within the circulation unit seals against an outer surface of the tool string;
- the wellbore cleanout tool is provided with an outlet forming a gate portion, and the gate portion is positioned within the circulation unit above the lower seal member;
- a collected debris in the wellbore cleanout tool is unloaded in the circulation unit through holes positioned in the gate portion, and unloaded debris is transported out of the circulation unit through an outlet positioned above the lower seal member; and
- fresh liquid is filled into the wellbore cleanout tool from the lubricator below the circulation unit through an inlet at the leading end portion.

The circulation unit may be provided with an opening means, said opening means may displace a sliding port to uncover the through holes in the gate portion. The opening means may be a constriction, or a locking profile as explained above.

The lubricator assembly may be provided with a filter cleaning unit, and wherein a filter in the wellbore cleanout tool's outlet may be cleaned by displacing the tool string until the outlet is positioned within the filter cleaning unit. The filter may be positioned on a sliding port. The filter may be positioned on a wall of the wellbore cleanout tool below the sliding port. Below is in the direction of a front tool of the tool string.

In one embodiment the cleanout tool is emptied within the lubricator by using the well pressure as driving force. Well fluid enters the cleanout tool through the inlet at the leading end portion and collected debris is forced out through the outlet at the opposite end of the cleanout tool, the lubricator via the circulation unit's outlet 3 and into a reservoir.

In alternative embodiment the cleanout tool is emptied by isolating the lubricator from the well. A cleaning fluid is pumped into the lubricator below the circulation unit. This enables cleaning fluid to be directed into the leading end portion of the wellbore cleanout tool to help drive the collected debris out of the wellbore cleanout tool and lubricator via the circulation unit's outlet 3 and into a reservoir.

In the following are described examples of preferred embodiments illustrated in the accompanying drawings, wherein.

Figure 3A:
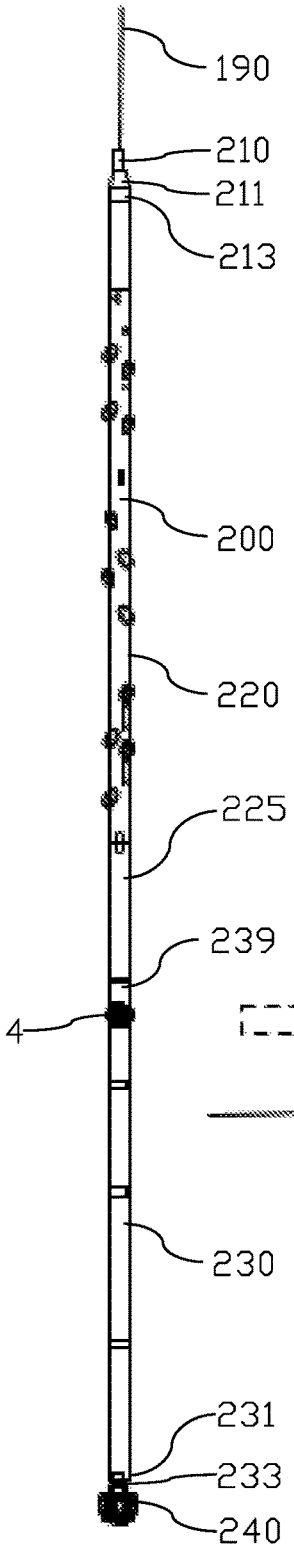
Figure 3B:
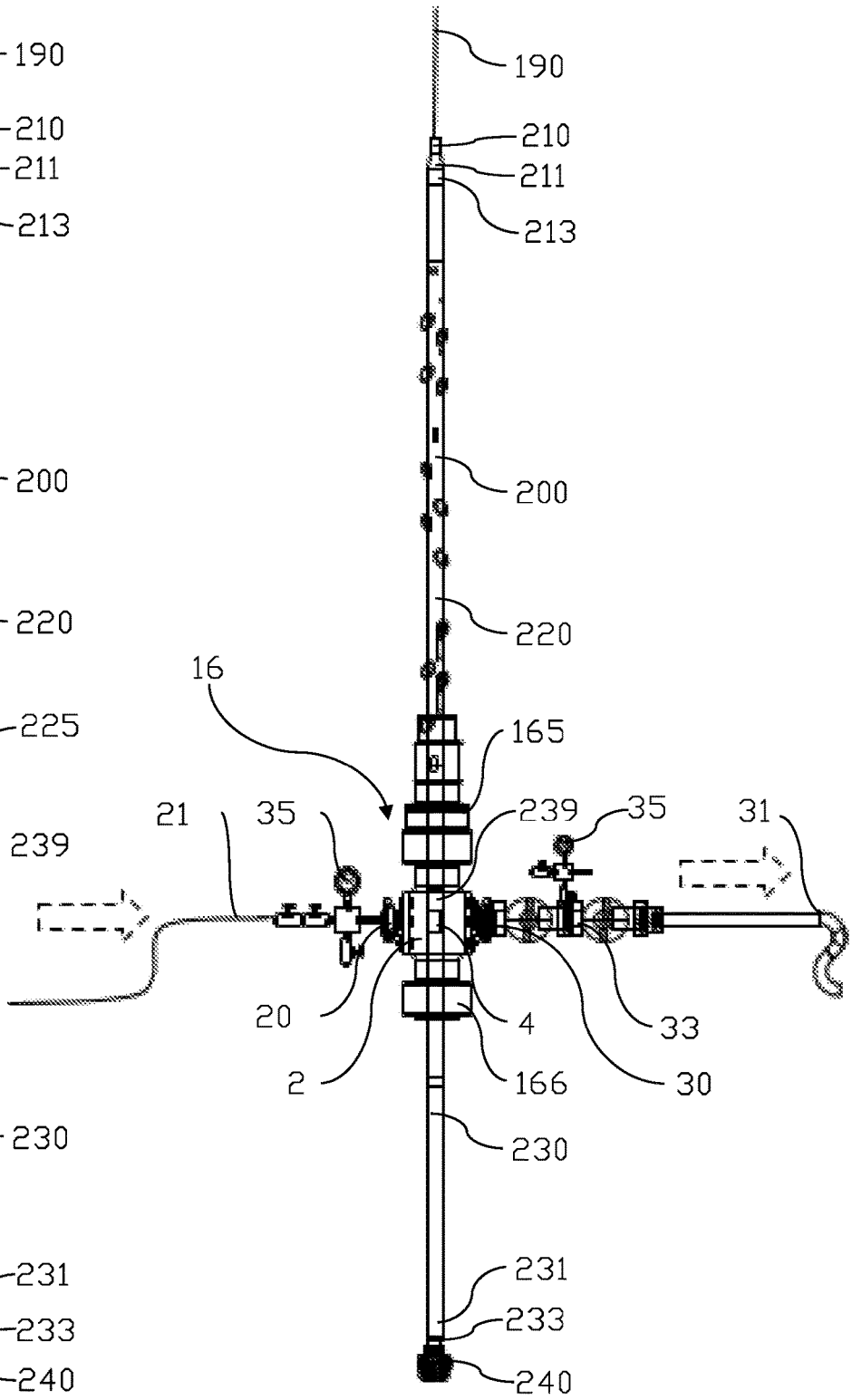
Figure 4A:
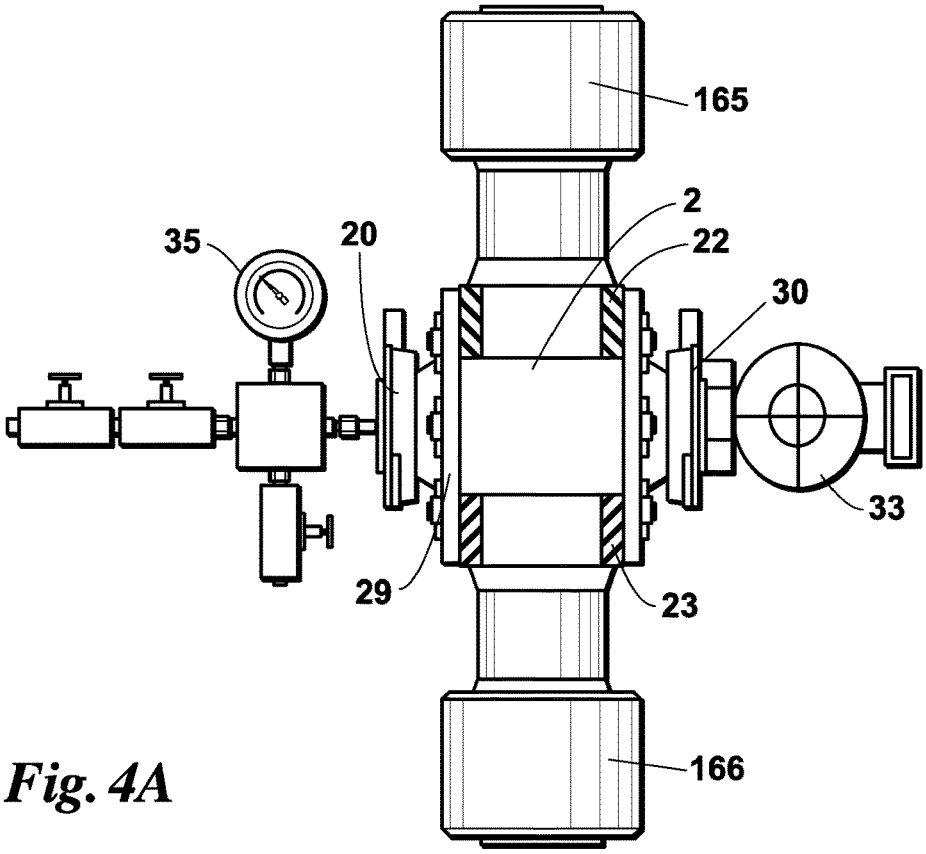
Figure 4B:
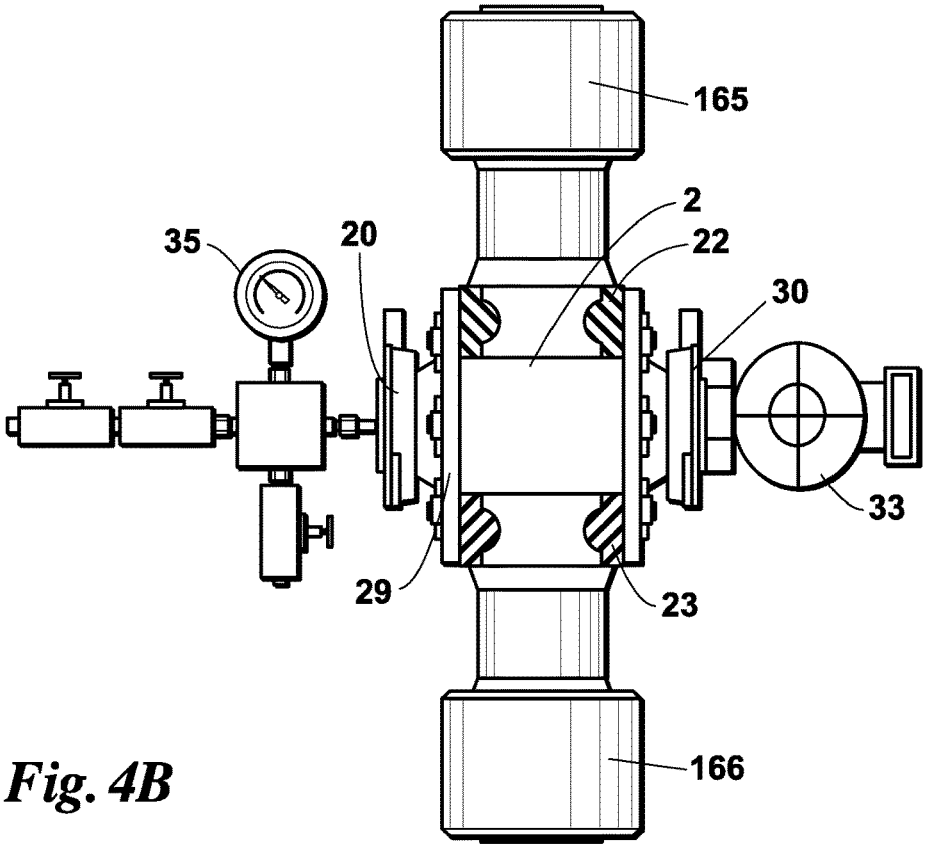
Figure 5A:
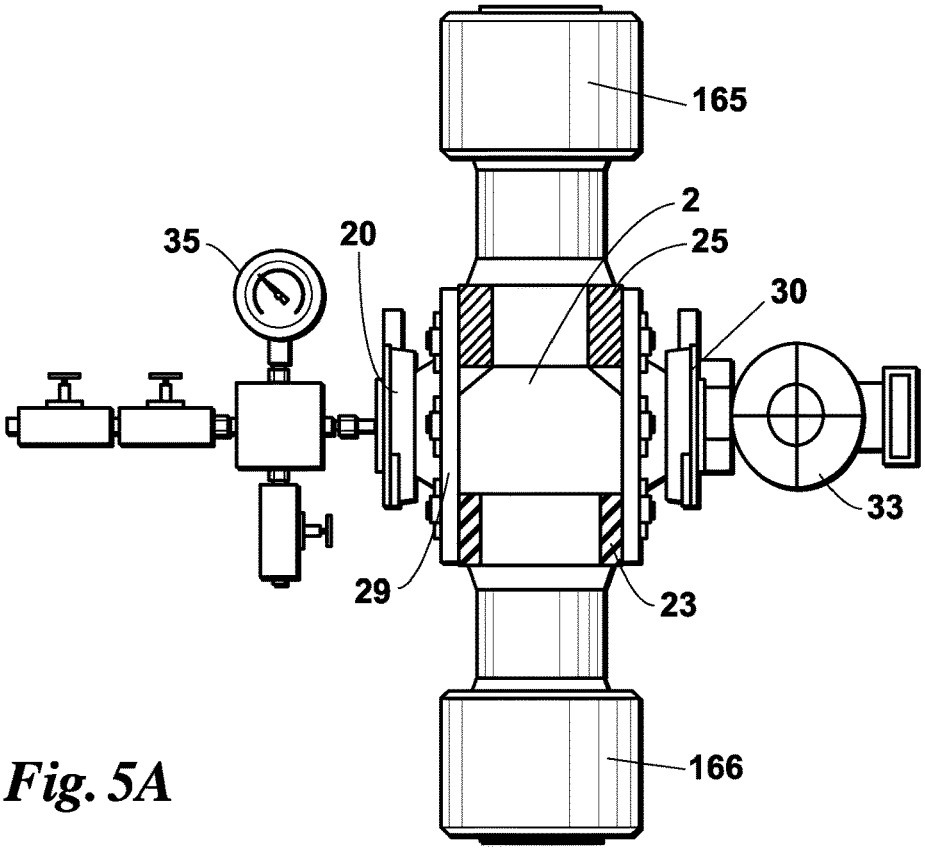
Figure 5B:
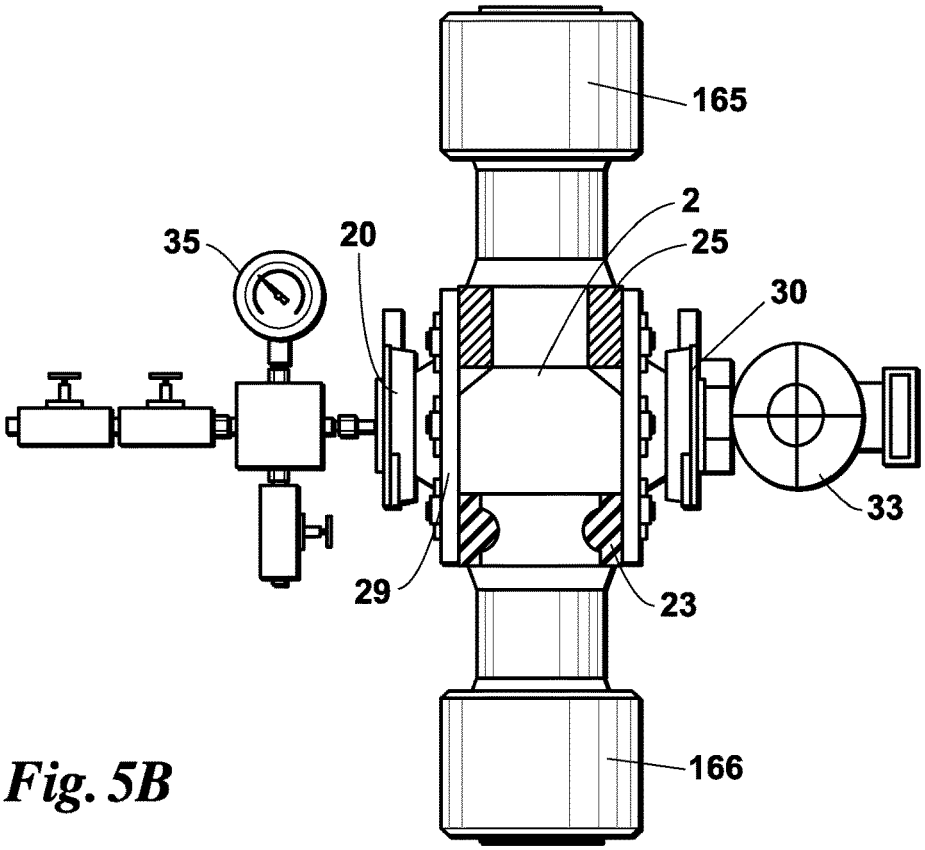
Figure 6A:
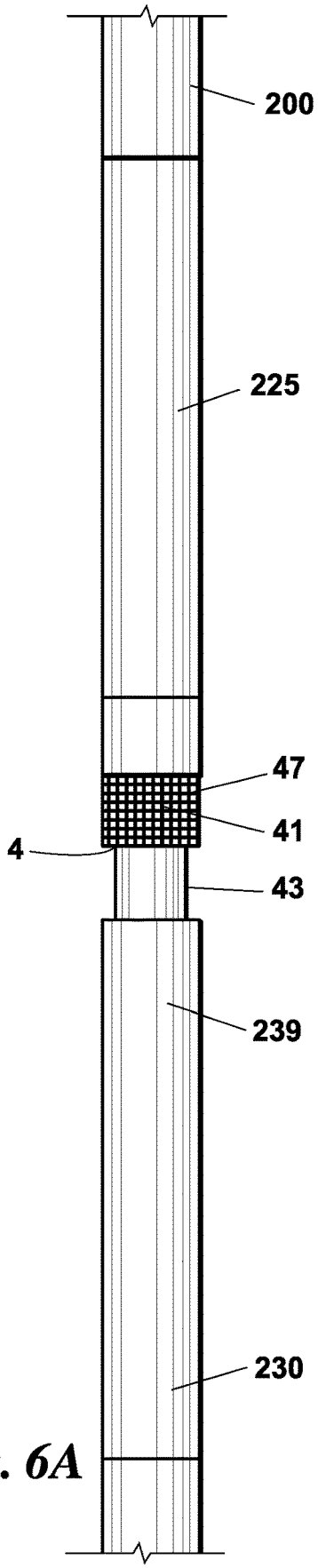
Figure 6B:
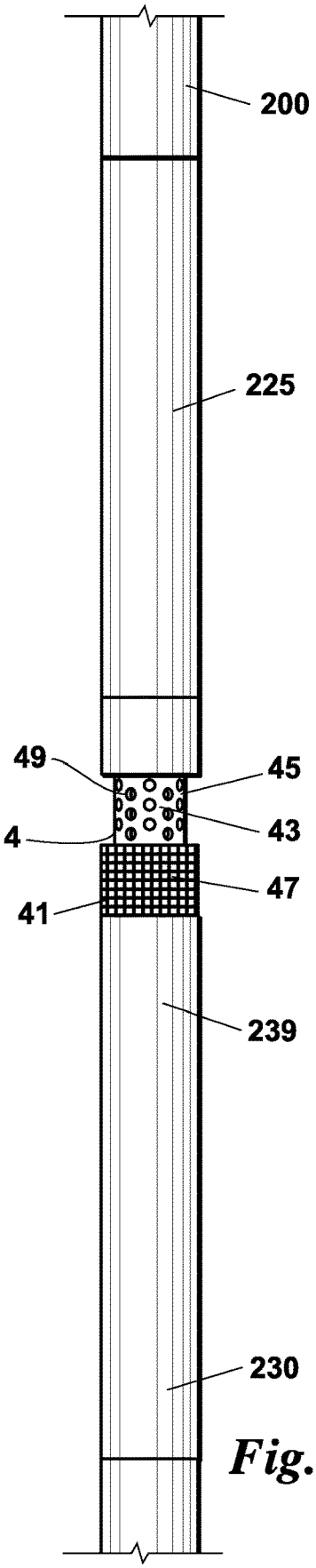
Figure 7A:
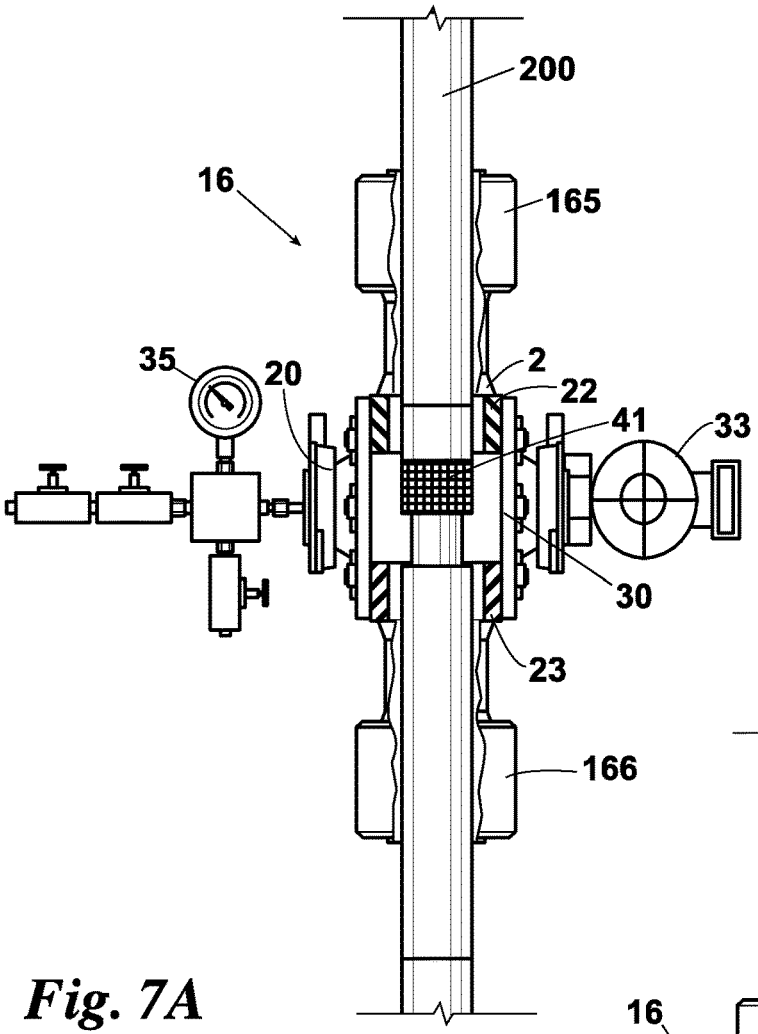
Figure 7B:
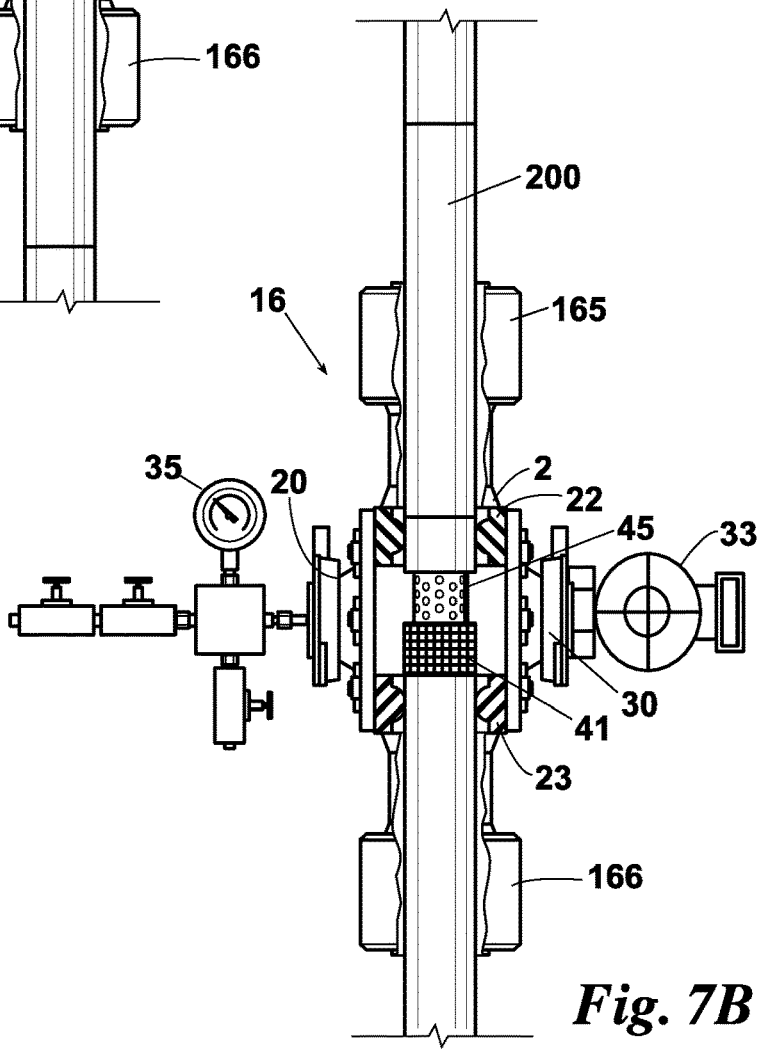
Figure 8:
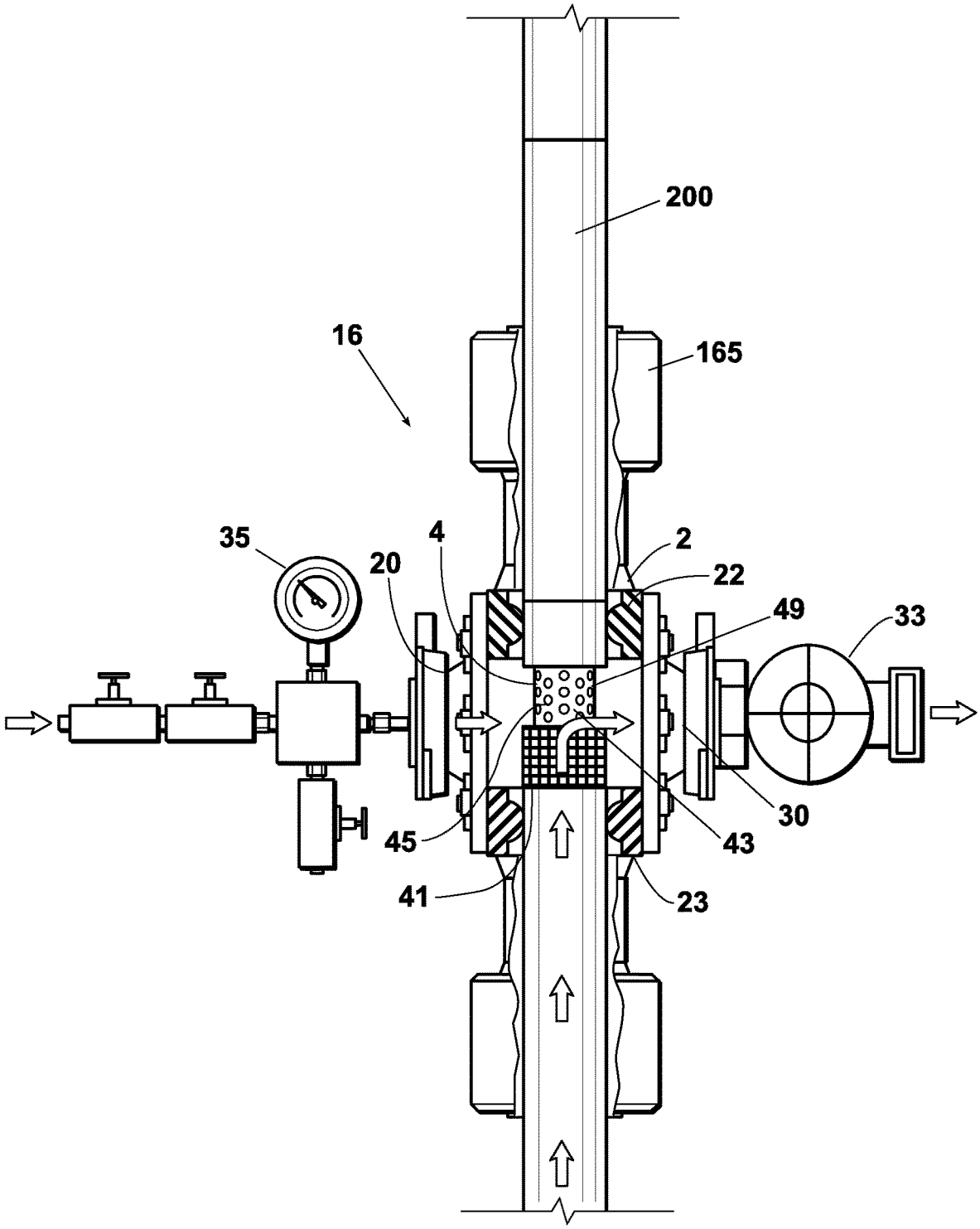
Figures 9, 10:
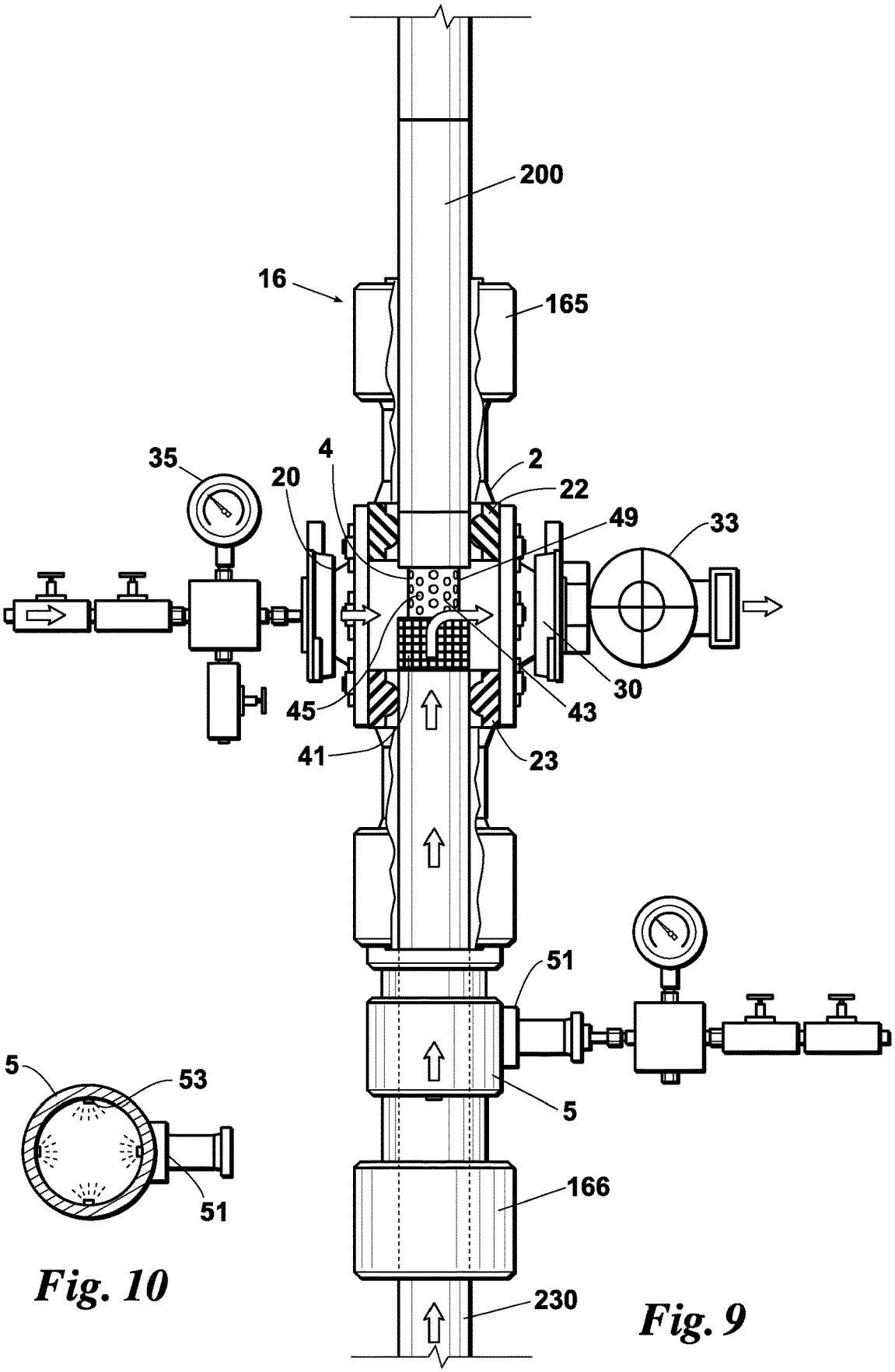
Figure 11:
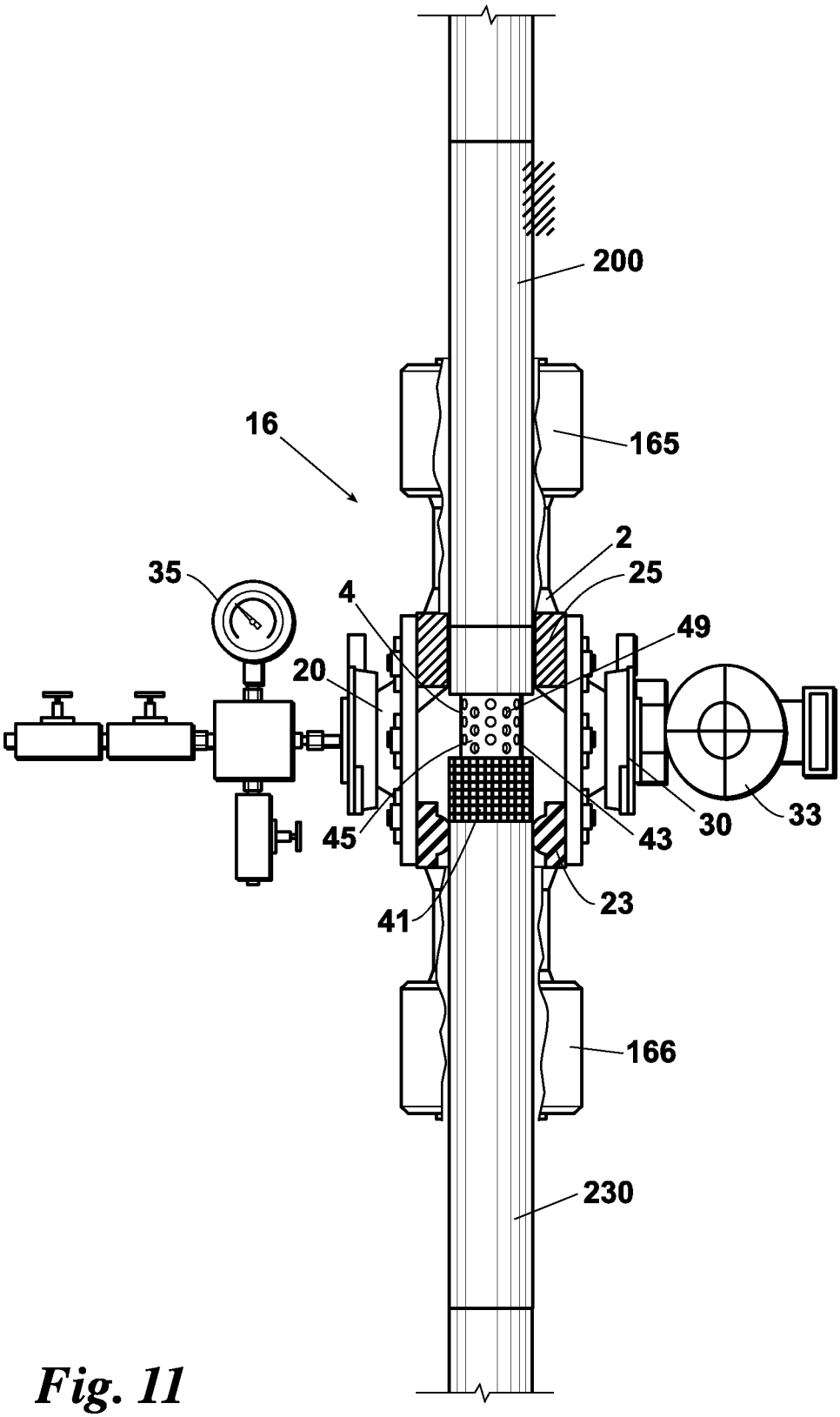

FIG. 3A-B show in a larger scale a tool string with a collecting unit according to the invention and the bottom hole assembly positioned within a circulation unit of the lubricator according to the invention, where the other elements of the lubricator is cut away;

FIG. 4A-B show in a larger scale the circulation unit, partly in side elevational view, partly in cross sectional view, where seal members are shown in a passive state (A) and in an active state (B);

FIG. 5A-B show in the same scale as FIGS. 4A-B, the circulation unit, partly in side elevational view, partly in cross sectional view, an alternative embodiment, where a seal member is shown in a passive state (A) and in an active state (B);

FIG. 6A-B show in a different scale a portion of the collecting unit with a sliding valve, in FIG. 6A the sliding valve covers a through opening in the wall of the collecting unit and displays a filter portion in the wall of the collecting unit, in FIG. 6B the sliding valve displays the through opening;

FIG. 7A-B show in a different scale the same as FIGS. 4A-B with the collecting unit inside the circulation unit, in FIG. 7A the collecting unit is in the closed state, in FIG. 7B the collecting unit is in the open state;

FIG. 8 shows in a larger scale the same as FIG. 7B with indications of flow directions;

FIG. 9 shows the same as FIG. 8, but an embodiment with a filter cleaning unit;

FIG. 10 shows in the same scale as FIG. 9, the filter cleaning unit viewed along the longitudinal axis of the lubricator; and FIG. 11 shows in the same scale as FIG. 8, an alternative circulation unit.

Figure 1:
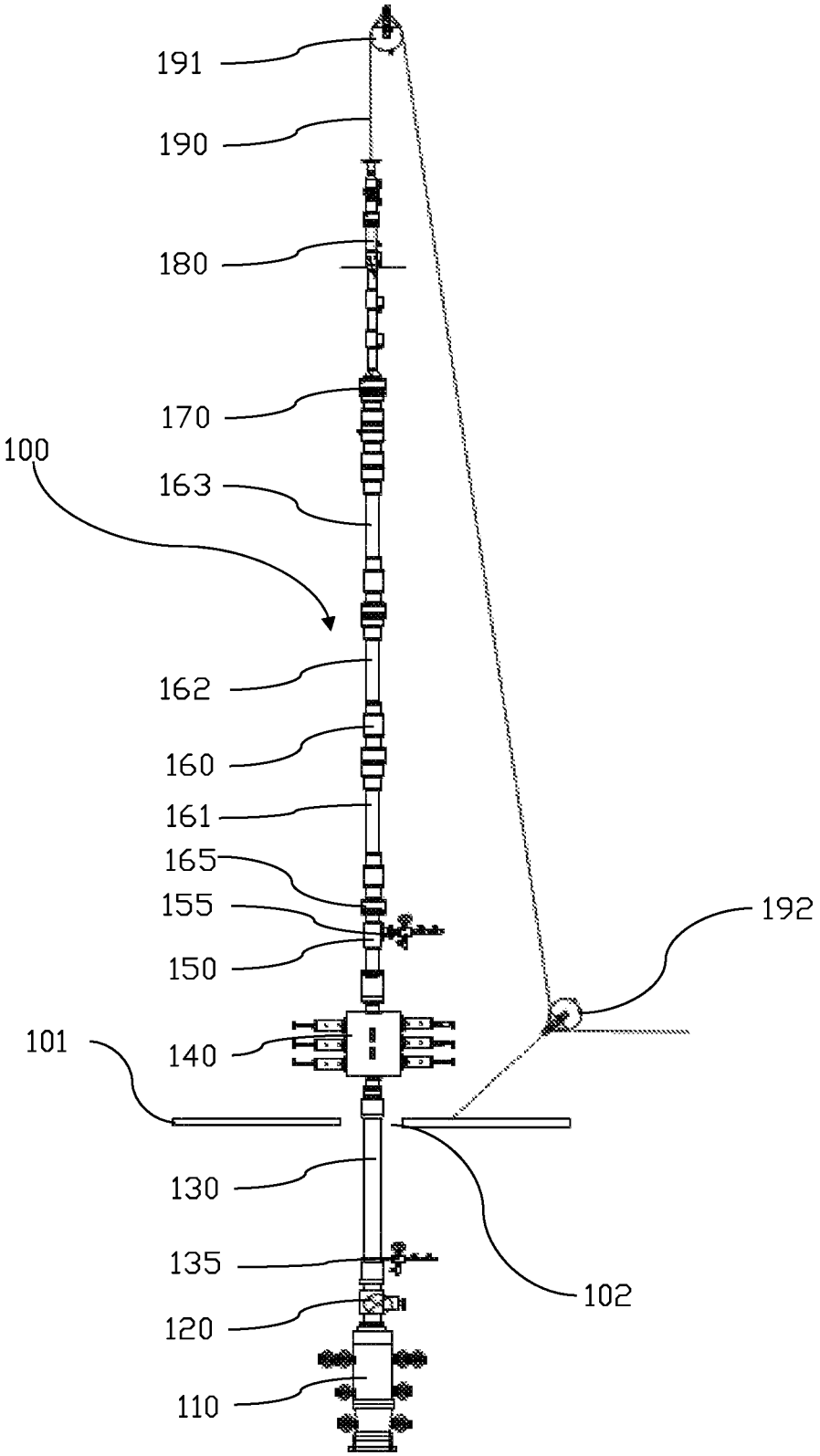
Fig. 1 Prior Art
FIG. 1 shows a layout of pressure control equipment with a standard lubricator for a wire line operation according to prior art.

In the drawings, the reference numeral 100 indicates a known arrangement for a pressure-controlled wireline intervention in a petroleum well (not shown). FIG. 1 shows from bottom towards the top a well head 110, also known as a Christmas tree/X-mas tree in the art, a cut valve/work valve 120, which may be manually or hydraulically operated, a riser 130 provided with a manifold 135, a blowout preventer (BOP) 140, a quick test sub (QTS) 150 with a manifold 155, a lubricator 160 shown with three lubricator sections 161, 162, 163, a tool catcher 170, a pressure control device 180, a cable 190 and a first sheave wheel 191. The cable 190 passes the first sheave wheel 191 and thereafter a second sheave wheel 192. The cable 190 is in one end connected to a hoisting device, typically a winch (not shown). In the opposite end the cable 190 is connectable to a tool string 200 as shown in FIGS. 3A-B.

As is common on many wireline operations on offshore installations, the riser 130 extends above a deck 101 through a hole 102. Depending on local conditions the deck 101 may be e.g. a hatch deck, a skid deck or an intervention deck. The pressure control device 180 is adapted to the type of cable 190. E.g. if the cable 190 is a slick line, the pressure control device 180 is a stuffing box system, if the cable 190 is a braided wire line cable, the pressure control device 180 is a grease injection head (GIH), as known to the skilled person.

The lubricator 160 forms a sluice for the tool string 200. The pressure control device 180 forms a tight pressure barrier at the top, and the quick test sub 150 may form a tight pressure barrier at the bottom of the lubricator 160. As per prior art way of conducting a wireline based wellbore cleanout operation, each time the tool string 200 is to be removed from the lubricator 160 after a run into the well, the cut valve/work valve 120 is closed, and the manifold 155 or the manifold 135 is opened to reduce the pressure, and the lubricator 160 is drained for fluid through the manifold 155 or the manifold 135. In some cases, the lubricator 160 is additionally flushed with nitrogen to remove all residuals and any hydrocarbon gases. Thereafter the lubricator 160 is opened, usually in the quick test sub 150. Thereafter the lubricator 160 is lifted off the quick test sub 150, whereupon the tool string 200 is laid down on deck using methodology as would be known to a person skilled in the art. For operations involving a known wellbore cleanout tool, when the tool is laid down, debris unloading is performed, together with any between-run maintenance, prior to hoisting it into the lubricator 160 again for another run in the well. This is a time-consuming procedure, and the operators may also be exposed to associated risks such as falling objects, exposure to hydrocarbons and other wellbore material such as low radioactivity material.

Figure 2A:
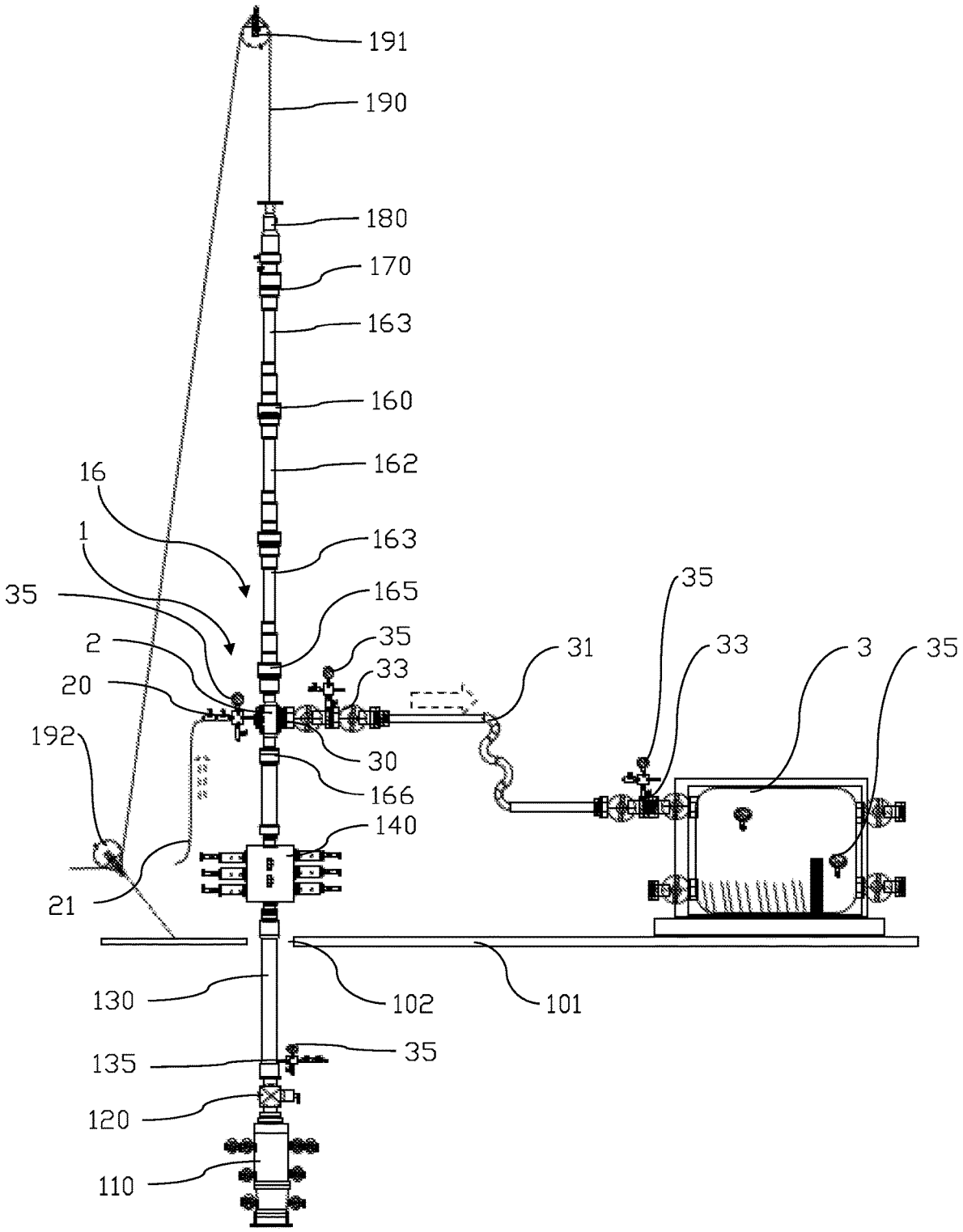
FIG. 2A shows in the same scale as FIG. 1 a layout for a wire line pressure control equipment according to one embodiment of the invention.

An arrangement 1 for a pressure-controlled wireline intervention in a petroleum well provided with a circulation unit 2 is shown in FIG. 2A. The lubricator 160 and the circulation unit are parts of a lubricator assembly 16. The circulation unit 2 comprises an open house 29 (see e.g. FIG. 4A). The circulation unit 2 is connected to the lubricator 160 by an upper lubricator connection 165 above the house 29 and by a lower lubricator connection 166 below the house 29. The lubricator connections 165, 166 and the house 29 form a through passage for the tool string 200 in the lubricator 160. The house 29 is provided with an outlet 30. As known in the art, sections of a lubricator 160 are joined by threaded connections. The lower part of each section comprises a pin portion provided with a sealing member such as an O-ring. The lower part is provided with a flange and a collet. The collet rests on the flange and rotates freely on the flange and coaxially around the pin portion. The collet is provided with internal threads. The upper part of each section comprises a box portion provided with external threads that mate with the internal threads of the collet. The pin portion is lowered into the box portion of the adjacent section below. The collet is winded to make up the connection. The upper lubricator connection 165 comprises a box portion with external threads (not shown) as described for a general lubricator section. The lower lubricator connection 166 comprises a pin portion, a flange and a collet provided with internal threads (not shown) as described for a general lubricator section. The circulation unit 2 is fastened to the lubricator 160 by winding and fastening the adjacent collet above the upper lubricator connection 165, and by winding and fastening the collet on the lower lubricator connection 166 to the lubricator section below.

According to one embodiment of the invention, the outlet 30 is connected to a reservoir such as a debris separator 3 by a tube system 31. The tube system 31 is provided with valves 33. The tube system 31 guides hydrocarbons, water, sand and other unloaded debris from a cleanout tool 230 from the lubricator 160 to the debris separator 3. The tube system 31 is robust and suited for the purpose. The debris separator 3 may be a test separator permanently installed on the facility or a temporary installed test separator. A temporary installed debris separator 3 may be connected to a permanently installed test separator further downstream. For this embodiment, the intention being to perform the unloading of the wellbore cleanout tool 230 without bleeding off the lubricator 160 pressure, or at least, with the lubricator partially pressurized, which is beneficial from a time consumption point of view. For this embodiment, it is seen as an advantage to provide the riser 130, lubricator 160, tube system 31 and debris separator 3 with pressure gauges 35. The pressure gauges 35 may be digital gauges. The digital gauges could also be sensors for detecting; temperature, density, particle, volume and flow. In this embodiment, the well pressure is the driving force for emptying the cleanout tool 230. Well fluid enters an inlet 233 at a leading end portion 231 of the wellbore cleanout tool 230 and drives the collected debris out of the wellbore cleanout tool 230 and lubricator 160 via the outlet 30 and into the separator 3.

The circulation unit's 2 house 29 is further provided with an inlet 20 for an injection of a cleaning fluid. The cleaning fluid may be a wash medium, such as a well fluid, monoethyl glycol (MEG), water, nitrogen gas, etc. For the embodiment shown in FIG. 2A, an injection hose 21 is connected to the inlet 20 and the cleaning fluid flows through the injection hose 21. The collected debris in the cleanout tool 230 may be relatively dry and compact. The cleaning fluid may soften the collected debris and make it flowable. Thereby the collected debris will flow more easily out through the outlet 30.

Figure 2B:
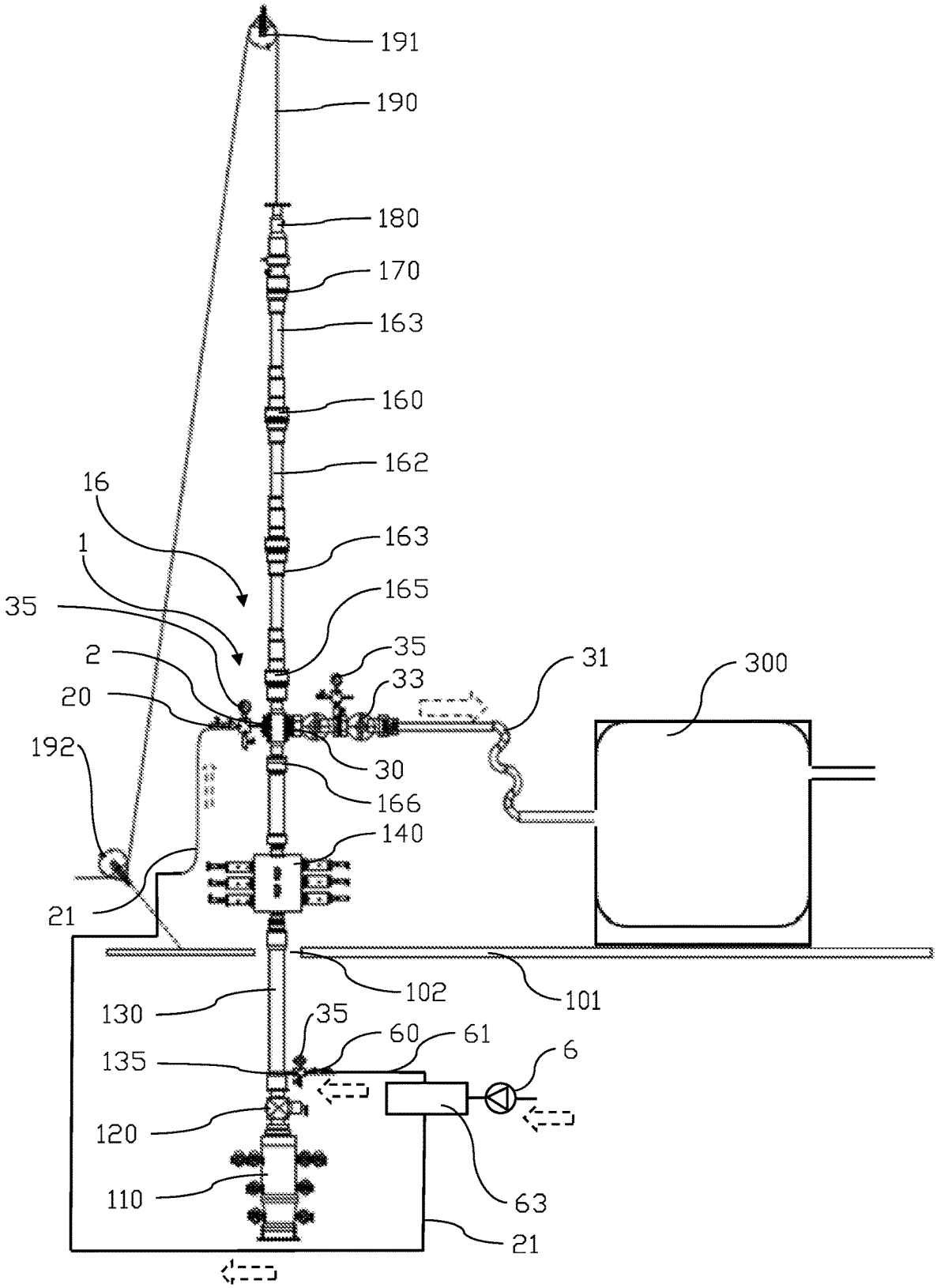
FIG. 2B shows in the same scale as FIG. 2 a layout for a wire line pressure control equipment according to an alternative embodiment of the invention.

In another embodiment of the invention, shown in FIG. 2B, the outlet 30 is connected via the tube system 31 to a reservoir such as a generic disposal tank 300 that are not designed for pressurised conditions. In one embodiment, these disposal tank 300 are transparent tank such as a plastic tank. In this embodiment, the pressure control arrangement 1 and lubricator 160 is bled down to ambient pressure, as would be known to a person skilled in the art, prior to offloading the wellbore cleanout tool 230 into the disposal tank 300 via the outlet 30 and tube system 31. Moreover, for this embodiment, an injection line 61 connects a pump 6 to an inlet 60 on the pressure control arrangement 1 where the inlet 60 is below the circulation unit 2. The manifold 135 may be the inlet 60. The pump 6 pumps a cleaning fluid into the pressure control arrangement 1 below the circulation unit 2. According to a preferred embodiment, this enables cleaning fluid to be directed from the pump 6 into the inlet 233 at the leading end portion 231 of the wellbore cleanout tool 230, to help drive the collected debris out of the wellbore cleanout tool 230 and lubricator 160 via the outlet 30 and into the disposal tank 300. In one embodiment, the wellbore cleanout tool's 230 collecting mechanism such as an auger, a pump, etc. (not shown) is operated simultaneously with the pump 6 for optimal unloading and cleansing of the wellbore cleanout tool 230 between runs. For the embodiments where the disposal tank 300 are transparent, verification that the wellbore cleanout tool 230 having collected debris from the well can be achieved from visual inspection into the disposal tank 300. Moreover, according to one embodiment, the pump 6 can be directed, via a manifold 63 and line 21 to the inlet 20 of the circulation unit 2, with the valve 33 of the outlet 30 closed, to build pressure inside the circulation unit 2 which is in fluidic connection with an outlet end portion 239 of the wellbore cleanout tool 230, said pressure build up being used to verify that a bottom retention valve (not shown) of the wellbore cleanout tool 230 is functional and ready for a new run in the hole. For this embodiment of the invention, slightly longer time is spent to bleed off and re-pressurize the pressure control arrangement 1 between runs than what may be the case for the embodiment using a debris separator 3 capable of withstanding high pressure. However, benefits being that it provides a simple means such as visual inspection for verifying that the wellbore cleanout tool 230 has collected debris.

The tool string 200 is shown in FIG. 3A. From top to bottom the tool string 200 comprises a cable head 210, a depth monitoring unit 211 (e.g. a casing collar locator [CCL] or a Gamma ray [GR]), a swivel 213, a wireline tractor 220 as known in the art, a motor 225, a wellbore cleanout tool 230 and a front tool 240. The wellbore cleanout tool 230 forms a leading end portion 231 and an opposite outlet end portion 239. The leading end portion 239 comprises an inlet 233. The front tool 240 may be a drill bit or a scraper or other suitable devices for loosening debris (not shown) in the well tubing (not shown) and transporting the debris into the wellbore cleanout tool 230 through the inlet 233. In many cases, the leading end portion 231 of the tool 230 contains a retention valve (not shown) for retaining the collected debris when hoisting the wellbore cleanout tool 230 out of the well after collecting debris. The outlet end portion 239 comprises an outlet 4 which will be described in more detail later.

The wellbore cleanout tool 230 working principle may be an auger-based collecting system, a suction tool collecting system with or without a bit in the end, or a suction, jetting and rotating collecting system. Alternatively, the collecting system mechanism may be a mechanical collecting device (not shown) used on a mechanical tool string where gravitation forces are used to displace the collecting device into the debris and thereby filling the collecting device.

FIG. 3B shows the tool string 200 positioned within the lubricator 160. Most parts of the lubricator 160 is not shown to simplify the figure. The outlet 4 is aligned with the circulation unit 2. In one embodiment the tool string 200 is locked in this position by the tool catcher 170 (see FIGS. 2A-B) or similar mechanism, as would be appreciated by a person skilled in the art.

The circulation unit 2 is shown in a first embodiment in FIGS. 4A-B. The circulation unit 2 is provided with an internal upper seal 22 and an internal lower seal 23. FIG. 4A shows the seals 22, 23 in a retracted, passive position. The tool string 200 may be displaced axially and unrestricted past the seals 22, 23 when the seals 22, 23 are in the passive position. In an expanded, active position, as shown in FIG. 4B, the seals 22, 23 will seal against the surface of the tool string 200. The outlet 4 will be positioned between the upper seal 22 and the lower seal 23, as shown in FIG. 7A-B. When the seals 22, 23 are in the active position, the outlet 4 is isolated from the lubricator 160. The seals 22, 23 may be activated by hydraulic fluid or by other suitable means as known in the art. In an alternative embodiment the seals 22, 23 are adapted to the outer diameter of the tool string 200. In this embodiment the seals 22, 23 are statically sealing the outlet 4 from the lubricator 160 when the outlet 4 is positioned between the upper seal 22 and the lower seal 23.

The circulation unit 2 is shown in a second embodiment in FIGS. 5A-B. The circulation unit 2 is provided with a lower seal 23 and a constriction 25. The constriction 25 is positioned in the upper part of the circulation unit 2. The lower seal 23 may be in a retracted passive position as shown in FIG. 5A or in an expanded active position as shown in FIG. 5B. In an alternative embodiment the lower seal 23 is adapted to the outer diameter of the tool string 200. When the seal 23 is in the active position, the outlet 4 is isolated from the portion of the lubricator 160 that is positioned below the circulation unit 2.

The wellbore cleanout tool 230 comprises an outlet mandrel 43 at the outlet 4 (see FIGS. 6A-B). The outer diameter of the outlet mandrel 43 may be less than the outer diameter of the wellbore cleanout tool 230 as shown in FIGS. 6-11. The outlet mandrel 43 comprises a gate portion 45. The gate portion 45 comprises several through holes 49 in a wall of the outlet mandrel 43. Further to one embodiment of the invention, a sliding port 41 is axially displaceable along the outlet mandrel 43 and is attached to the wellbore cleanout tool 230 or to the outlet mandrel 43. The sliding port 41 may be a sliding sleeve as shown in FIGS. 6-11. In one embodiment the sliding port 41 comprises a filter unit 47. In one embodiment, the filter unit 47 is actively used to retain debris inside the wellbore cleanout tool 230 during the downhole cleanout operation.

The sliding port 41 may be provided with a resilient biasing means (not shown) that biases the sliding port 41 axially along the outlet mandrel 43 to cover the gate portion 45 when the wellbore cleanout tool 230 is run and operated in the well. The resilient biasing means may be a coil spring. After hoisting the wellbore cleanout tool 230 out after an ended cleanout run in the well, upon entering the circulation unit 2, an opening means within the circulation unit 2 displaces the sliding port 41 axially towards the front tool 240 when the outlet 4 is displaced upwardly within the circulation unit 2. The opening means may be the constriction 25 which is adapted to open the sliding port 41. As per this embodiment, upon hoisting the wellbore cleanout tool 230 into the circulation unit 2, the biasing means is further tensioned by the axial displacement of the sliding port 41 towards the front tool 240. After unloading, the wellbore cleanout tool 230 is lowered downwardly out of the circulation unit 2, whereupon the biasing means forces the sliding port 41 axially along the outlet mandrel 43 towards the cable head 210, covering the through holes 49 in the gate portion 45 again. In an alternative embodiment, the circulation unit 2 is provided with a locking profile (not shown) which engage with locking dogs onto the sliding port 41 to facilitate shifting this open, as would be appreciated by a person skilled in the art. In yet another embodiment, the circulating unit 2 is provided with orientation means that engage with corresponding orientation means in the outlet 4, that orient and align the holes in the gate portion 45 with respect to the holes in the outlet 30 of the circulation unit 2.

In an alternative embodiment (not shown) a portion of the outlet mandrel 43 is provided with a filter in the mandrel wall adjacent the gate portion 45. The filter is exposed when the sliding port 41 is axially displaced to cover the through holes 49 of the gate portion 45.

In a further alternative embodiment, the tool string 200 is not provided with a filter at the outlet 4. This may be the case for a wellbore cleanout tool 230 that uses flow to create a suction and/or jetting effect to clean the well, and where there is a debris retention filter in the internals of the tool. In this embodiment the sliding port 41 covers the gate portion 45 when the wellbore cleanout tool 230 collects debris downhole. For all embodiments, the gate portion 45 of the wellbore cleanout tool 230 is in direct contact and/or communication with the wellbore cleanout tool's 230 collecting chambers housing the collected debris.

During collection of debris within the well, the sliding port 41 covers the gate portion 45 as shown in FIG. 6A. When the tool string 200 is positioned within the lubricator 160 such that the outlet 4 is properly positioned within the circulation unit 2, the sliding port 41 is displaced axially and the gate portion 45 becomes uncovered as shown in FIG. 6B. The collected debris within the wellbore cleanout tool 230 may now pass through the holes 49 and the wellbore cleanout tool 230 is emptied by this route as shown by arrows in in FIG. 8. When the tool string 200 is lowered into the well, the sliding port 41 covers the gate portion 45 again. In the embodiment where the sliding port 41 comprises a filter 47, only well fluid and small particles may pass through the through holes 49 and the filter 47. Solids are collected within the wellbore cleanout tool 230.

Operation of the outlet 4 is shown in FIGS. 6-11.

FIG. 7A shows the tool string 200 positioned within the lubricator 160 (the lubricator 160 being cut away from FIGS. 7A-B) and the outlet 4 with the sliding port 41 properly positioned in the circulation unit 2 between the upper seal 22 and the lower seal 23. The seals 22, 23 are in the passive position and the sliding port 41 with the filter 47 covers the gate portion 45. FIG. 7B shows the same as FIG. 7A, but the seals 22, 23 are activated and the sliding port 41 with the filter 47 has been displaced to uncover the gate portion 45.

In an alternative embodiment, the lubricator 160 is further provided with a filter cleaning unit 5 as shown in FIG. 9. The filter cleaning unit 5 comprises an inlet 51 for a cleaning fluid and the inlet 51 communicates with internal nozzles 53. The nozzles 53 are distributed around the filter cleaning unit's 5 circumference and the nozzles 53 direct the cleaning fluid radially towards the centre of the lubricator 160 as shown in FIG. 10.

In a further alternative embodiment, the lubricator 160 is further provided with an inspection unit (not shown). The inspection unit may be an optical camera, an infrared camera, an X-Ray scanner, an ultrasound scanner, a magnetic resonance scanner or an inspection window. This inspection unit may be a supplement to tool string instrumentation to check and verify the debris collecting tool string before an additional roundtrip into the well.

The tool string 200 is shown in an alternative embodiment in FIG. 11. The outer diameter of at least a portion of a lower portion of the wellbore cleanout tool 230 is larger than the outer diameter of an upper portion of the tool string 200. When the wellbore cleanout tool 230 abuts the constriction 25, further upward displacement of the tool string 200 within the lubricator 160 will displace the sliding port 41 towards the front tool 240 (see FIGS. 3A-B) and uncover the gate portion 45.

The wellbore cleanout tool 230 may comprise transporting means (not shown) such as a pump or an auger to transport debris into the wellbore cleanout tool's 230 collecting chamber. In one embodiment, the front tool 240 assists in loosening consolidated debris within the well. Typically, a motor (not shown) within the motor housing 225 is supplied with electrical energy through the cable 190, whereupon it powers relevant tool modules such as the front tool 240, a pump or an auger. In one embodiment, the sliding port 41 serves an active purpose in the downhole cleanout operation by retaining the debris within the wellbore cleanout tool 230. In alternative embodiments, debris retention means such as filters may be located elsewhere in the wellbore cleanout tool 230. Here, the sliding port 41 mainly serves the purpose of establishing communication between the wellbore cleanout tool's 230 collecting chamber and the circulation unit 2 during the unloading activity on surface. When the wellbore cleanout tool 230 is full, or all debris has been collected from the well, the tool string 200 is hoisted out of the well and returned to the lubricator 160.

In one embodiment, the wellbore cleanout tool 230 is a mechanical bailer or pump bailer, with a top portion of the bailer adapted as per the invention herein, such as with a spring forced sliding sleeve that uncovers a gate portion 45 when the bailer abuts the constriction in the circulation unit 2, enabling the unloading of debris from the bailer via the circulation unit 2 as per methods described herein.

In one embodiment the circulation unit 2 may be provided with a tool catcher (not shown) that grips the tool string 200 and keep the tool string fixed in a correct position. In other embodiments the tool catcher 170 grips the tool string 200.

In one embodiment of the invention, the valves which isolates the lubricator 160 from the well may be closed after the tool string 200 is fixated. In another embodiment they remain open. This may depend on regulatory guidelines, relevant operational constraints, conditions at the well site, and on what type of debris receiving and debris management system that is being used to unload debris on the surface e.g. debris separator 3 or non-pressurized tank 300.

For any of the above embodiments, it is considered advantageous that the wellbore cleanout tool's 230 surroundings inside the pressure control arrangement 1 being filled with liquid and not gas. If gas is present, it would be preferred to close the valves and fill the surroundings between the tool string 200 and the lubricator 160 with a suitable liquid, such as monoethyl glycol (MEG).

After fixation of the tool string 200, the lower seal 23 is activated. If the circulation unit 2 is provided with an upper seal 22, the upper seal 22 is activated. The portion of an annulus below the lower seal 23 is then isolated from the annulus above the lower seal 23. If an upper seal 22 is present, the annulus above the upper seal 22 is then isolated from the annulus below the upper seal 22. An annulus portion forms between the activated lower seal 23 and the activated upper seal 22.

The inlet 20 is positioned in the annulus portion above the lower seal 23, and below the upper seal 22, if the upper seal 22 is present. The outlet 30 is positioned in the annulus portion above the lower seal 23, and below the upper seal 22, if the upper seal 22 is present. The gate portion 45 is positioned in the annulus portion above the lower seal 23, and below the upper seal 22, if the upper seal 22 is present, as well.

For the embodiment of the invention using a debris separator 3 capable of operating at elevated pressure conditions, this is connected to the outlet 30. A wash medium (not shown), such as well fluid, MEG, water or nitrogen gas flows or is being pumped through the injection hose 21 and the inlet 20 and enters the annulus portion within the circulation unit 2. This flow may clean the gate portion 45. The wellbore cleanout tool 230 is now ready for unloading.

Unloading may be performed by several methods. In one embodiment, where the pressure control arrangement 1 is kept at an elevated pressure during unloading, the pressure within the debris separator 3 may be lowered to create a pressure difference between the debris separator 3 and the pressure control arrangement 1. Debris is unloaded by flow from the pressure control arrangement 1 and/or the well, through the wellbore cleanout tool 230, out the gate portion 45 and the outlet 30 to the debris separator 3, the flow being caused by said pressure difference.

In another embodiment, a flow of cleansing fluid may be provided to the leading end portion 231 by the pump 6 pumping cleansing fluid into the inlet 60 on the pressure control arrangement 1 that is located below the circulation unit 2, such as the manifold 135. The resulting flow causing the unloading of debris from the wellbore cleanout tool 230 to take place out the gate portion 45 and the outlet 30 to the debris separator 3 or a non-pressurized disposal tank 300.

In another embodiment, the flow of wash medium through the circulation unit 2 may create a similar suction effect within the wellbore cleanout tool 230.

In a preferred embodiment of the invention, in order to unload the wellbore cleanout tool 230, the means for filling and/or operating the wellbore cleanout tool 230 such as an auger, a pump or other working mechanism of the wellbore cleanout tool 230, being activated at the same time as pumping fluids by the pump 6 into the wellbore cleanout tool 230 via the leading end portion 231, out the gate portion 45 and the outlet 30 to the debris separator 3 or a non-pressurized disposal tank 300 as described above.

In one embodiment, the main means for unloading debris upwards in the wellbore cleanout tool 230, out through the gate portion 45 and the outlet 30 being the same means as are used for collecting debris and filling the wellbore cleanout tool 230 downhole, such as an auger, a pump or other working mechanism of the wellbore cleanout tool 230, or a combination of such means.

According to a preferred embodiment, the pressure difference between the wellbore cleanout tool's 230 inlet at the leading end portion 231, and the circulation unit 2 is monitored to control the unloading operation. Cleaning fluid from the manifold 63 enters the wellbore cleanout tool's 230 inlet at the leading end portion 231 to drive out and in addition volumetrically replace any unloaded debris. In one embodiment, volumetric displacement monitoring means are used to verify that the wellbore cleanout tool 230 collected debris downhole, and in addition for monitoring and verifying the unloading operation in general.

For the embodiment where the collected debris of the wellbore cleanout tool 230 is unloaded into a dedicated debris separator 3, the cleaning fluid may be residual fluid from the lubricator 160 and/or the well. For this embodiment, the cut valve/work valve 120 may be kept open whilst unloading the wellbore cleanout tool 230, whereupon unloading of the wellbore cleanout tool 230 takes place by well fluids flushing through the wellbore cleanout tool 230, the circulation unit 2, via the tube system 31 and into the debris separator 3. The flow rate may be controlled by the debris separator's 3 outlet valves, and the unloading continues until all collected debris from the wellbore cleanout tool 230 has been unloaded to the debris separator 3. The debris separator 3 may further be provided with a measuring glass so that the volume of collected debris is monitored. By this procedure, unloading of the wellbore cleanout tool 230 is performed in a fully closed system without any hazardous exposure of chemicals to the crew.

According to a preferred embodiment, for cases where the wellbore cleanout tool 230 is unloaded to a debris separator 3 or a non-pressurized disposal tank 300, cleaning fluid is pumped into the lubricator 160 below the lower seal 23, e.g. through the manifold 135 on the riser 130. The debris separator 3 or disposal tank 300 may be provided with means for monitoring weight to assess the amount of collected debris.

When the unloading is completed, the inlet 20 and the outlet 30 are closed. In one embodiment, the wellbore cleanout tool 230 is provided with a PCP pump (Progressive Cavity Pump, also known as a Moineau pump after the inventor) or other suitable pump type as a means for filling the wellbore cleanout tool 230. Here, upon unloading the wellbore cleanout tool 230, functionality of the PCP pump (verification of functionality prior to a subsequent run) is checked by running the pump against the closed volume inside the closed circulation unit 2. If pressure is rising and maintained at some elevated value, this being an indication that the tool's pump is working properly.

If the wellbore cleanout tool 230 is provided with a check valve (not shown) at the wellbore cleanout tool's 230 lower end portion, the check valve may be tested by closing the outlet 30 and by pumping a fluid through the inlet 20. Pressure will build up inside the wellbore cleanout tool 230 if the check valve is intact and working properly.

According to a preferred embodiment, when the tool string 200 is disconnected from the tool catcher inside the circulation unit 2 or the tool catcher 170, the inlet 20 and the outlet 30 are closed automatically as a safety measure. In one embodiment, this is verified by a sensor. In one embodiment, it is not possible to disconnect the tool string 200 from the tool catcher before the inlet 20 and the outlet 30 are completely closed.

The seals 22 and 23 are deactivated prior to disconnecting the tool string 200.

Before the next round-trip in the well, a filter test may be performed by flushing fluid through the wellbore cleanout tool 230 and through the filter whilst measuring delta pressure across it. Dependent on the arrangement, this may be performed in several different ways. In one embodiment, where the filter 41 is embedded in sliding port 47, prior to testing the filter, the through holes 49 in the gate portion 45 are closed by sliding the sliding port 47 to a closed position. This may be achieved by slightly lowering the tool string 200 within the circulation unit 2. If the tool string 200 is provided with a pump, the pump may be used to create fluid circulation to verify the filter with respect to plugging and restriction. If the tool string 200 is not provided with a pump, the lower seal 23 is activated to isolate the outside of the lower portion of the tool string 200 from the outside of the upper portion. Then, fluid is pumped into the lubricator 160 through the manifold 135 via the pump 6 and led into and through the wellbore cleanout tool 230 and the filter whilst monitoring delta pressure, to verify that the filter has not been plugged or damaged.

When performing flow tests through the wellbore cleanout tool 230 and filter 47 after unloading, fluids should pass unrestricted through the wellbore cleanout tool 230 and through the filter 47. If any resistance monitored, e.g. pressure drop of significance is observed, this indicates that the filter 47 is blocked or partly blocked. If so, according to one embodiment of the invention, the tool string 200 is lowered such that the filter 47 is positioned within the filter cleaning unit 5. The filter cleaning unit 5 is activated and the nozzles 53 spray a pressurized cleaning fluid over the filter 47. The wellbore cleanout tool 230 may be hoisted and lowered several times past active nozzles 53 to clean the filter 47 properly. In one embodiment, where the filter is located in the wall of the mandrel 43 below the sliding port 41, e.g. closer to the front tool 240, the filter cleaning procedure is the same.

In one embodiment, other equipment in the tool string 200, such as electrical motor(s) assemblies, wireline, tractor and anchoring means (not shown) may also be tested and/or prepared for a subsequent run with the tool string 200 hanging within the intact (not disconnected) lubricator 160. For example, lubricator 160 modules could be tailored for filling relevant tools with hydraulic oil between runs. After successful testing the tool string 200 is ready for another descent into the well.

Several modifications are possible within the frame of the present invention. The outlet 4 may be positioned closer to the inlet portion of the wellbore cleanout tool 230. There may be more than one outlet 4. The filter cleaning unit may be positioned within the circulation unit 2. This would be appreciated by a person skilled in the art.

For all embodiments, the invention provides the advantage that unloading of the wellbore cleanout tool 230 is performed within the lubricator 160, avoiding disconnecting and/or remove the lubricator 160 for unloading the wellbore cleanout tool 230.

For the embodiment where the wellbore cleanout tool 230 is unloaded into a pressurized debris separator 3, no pressure safety barrier is broken, and pressure testing before the next decent is not necessary. The process is a closed process and the field crew is not exposed to hazardous chemicals.

For all embodiments, the associated wireline operation for removing debris from a petroleum well becomes more efficient than previous known art and techniques conveyed on wireline. Experience indicate that prior art technology for removing debris from a well on wireline could be conducted in a pace of approximately three runs (trips in the well) per 24 hours as a high estimate. The inventors estimate that applying a design and method according to the present invention, enables six runs and even more per 24 hours, in particular if combining with novel types of wireline that permit a substantially higher running speed than wireline technology of current art.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A circulation unit being adapted for connecting to a lubricator, said lubricator comprises a number of lubricator sections and a pressure control device wherein the pressure control device is positioned above an upper lubricator section, and said lubricator is suitable for housing a wireline operated tool string for collecting debris within a petroleum well, said circulation unit comprises:

a house provided with an upper lubricator connection and with at least one lower internal seal member, said at least one lower internal seal member is adapted to seal against an outer surface of the tool string, a house outlet above the at least one lower internal seal member, said house outlet being connected to a reservoir, a lower lubricator connection;

the house, the upper lubricator connection and the lower lubricator connection form a through passage for the tool string into at least one lubricator section above the house, said at least one lubricator section is positioned between the house and the pressure control device;

the upper lubricator connection and the lower lubricator connection are adapted for connection to a pressurized lubricator; and wherein the circulation unit comprises an opening means for displacing a displaceable sliding port on the tool string.

2. The circulation unit according to claim 1, wherein the at least one lower internal seal member seals against the tool string in an active position.

3. The circulation unit according to claim 1, wherein the circulation unit comprises an upper seal member above the house outlet, said upper seal member is adapted to seal against a surface of the tool string.

4. The circulation unit according to claim 1, wherein the circulation unit comprises an inlet above the at least one internal lower seal member.

5. The circulation unit according to claim 4, wherein the inlet is positioned below an upper seal member, said upper seal member is adapted to seal against a surface of the tool string.

6. The circulation unit according to claim 1, wherein the lubricator and the circulation unit form a lubricator assembly.

7. The circulation unit according to claim 6, wherein the lubricator assembly is provided with a filter cleaning unit, the filter cleaning unit cleans a filter in the tool string.

8. The circulation unit according to claim 7, wherein the filter cleaning unit is positioned below the circulation unit.

9. The circulation unit according to claim 1, wherein the tool string comprises a wellbore cleanout tool forming a leading end portion and an opposite outlet end portion, and provided with filling means at an inlet at the leading end portion, wherein the outlet end portion comprises an outlet mandrel at an outlet for unloading collected debris, said outlet mandrel comprises a gate portion with through holes, and the tool string further comprises a sliding port provided with a filter adapted to cover the through holes and slidable to uncover the through holes, and the sliding port is adapted to be displaced within the lubricator.

10. A method for unloading a filled wellbore cleanout tool forming a leading end portion and an opposite outlet end portion, and being part of a tool string, the method comprising:

positioning the tool string within a lubricator assembly comprising a number of lubricator sections, a pressure control device positioned above an upper lubricator section and a circulation unit including an upper and a lower lubricator connection adapted for connection to a pressurized lubricator, wherein at least one lubricator section is connected to the upper lubricator connection and extending above the circulation unit;

sealing a lower seal member within the circulation unit against an outer surface of the tool string;

the wellbore cleanout tool being provided with a tool outlet forming a gate portion, and positioning the gate portion within the circulation unit above the lower seal member;

unloading collected debris in the wellbore cleanout tool in the circulation unit through holes positioned in the gate portion, and transporting unloaded debris out of the circulation unit through a house outlet in a house of the circulation unit, said house outlet positioned above the lower seal member;

filling fresh liquid into the wellbore cleanout tool from the lubricator below the circulation unit through an inlet at the leading end portion; and providing the circulation unit with an opening means and displacing a sliding port with the opening means to uncover the holes in the gate portion.

11. The method according to claim 10, further comprising providing the lubricator assembly with a filter cleaning unit, and cleaning a filter in the tool outlet by displacing the tool string until the tool outlet is positioned within the filter cleaning unit.

12. The method according to claim 11, wherein the filter is positioned on the sliding port.

13. The method according to claim 11, wherein the filter is positioned on a wall of the wellbore cleanout tool below the sliding port.

14. A circulation unit adapted for connecting to a lubricator, said circulation unit comprises:

a house provided with an upper lubricator connection and with at least one lower internal seal member, said at least one lower internal seal member is adapted to seal against an outer surface of the tool string, and an outlet above the at least one lower internal seal member, said outlet being connected to a reservoir;

a lower lubricator connection;

the house, the upper lubricator connection and the lower lubricator connection form a through passage for the tool string;

the upper lubricator connection and the lower lubricator connection are adapted for connection to a pressurized lubricator, wherein at least one lubricator section is connected to the upper lubricator connection; and a wire operated tool string comprising a wellbore cleanout tool forming a leading end portion and an opposite outlet end portion, and provided with filling means at an inlet at the leading end portion, wherein the outlet end portion comprises an outlet mandrel at an outlet for unloading collected debris, said outlet mandrel comprises a gate portion with through holes, and the tool string further comprises a sliding port provided with a filter adapted to cover the through holes and slidable to uncover the through holes, and the sliding port is adapted to be displaced within the lubricator.

15. A method for unloading a filled wellbore cleanout tool forming a leading end portion and an opposite outlet end portion, and being part of a tool string, the method comprising:

positioning the tool string within a lubricator assembly comprising a number of lubricator sections, a pressure control device positioned above an upper lubricator section and a circulation unit including an upper and a lower lubricator connection adapted for connection to a pressurized lubricator, wherein at least one lubricator section is connected to the upper lubricator connection and extending above the circulation unit;

sealing a lower seal member within the circulation unit against an outer surface of the tool string;

the wellbore cleanout tool being provided with a tool outlet forming a gate portion, and positioning the gate portion within the circulation unit above the lower seal member;

unloading collected debris in the wellbore cleanout tool in the circulation unit through holes positioned in the gate portion, and transporting unloaded debris out of the circulation unit through a house outlet in a house of the circulation unit, said house outlet positioned above the lower seal member; and providing the lubricator assembly with a filter cleaning unit, and cleaning a filter in the tool outlet by displacing the tool string until the tool outlet is positioned within the filter cleaning unit.

16. The method of claim 15, further comprising sealing an upper seal member against the outer surface of the tool string within the circulation unit.

17. The method of claim 15, further comprising providing the circulation unit with an opening means and displacing a sliding port with the opening means to uncover the holes in the gate portion.

18. The method according to claim 15, wherein the filter is positioned on a sliding port.

19. The method according to claim 15, wherein the filter is positioned on a wall of the wellbore cleanout tool below a sliding port.

* * * * *